United States Patent [19]

Rice

[11] Patent Number: 4,702,304

[45] Date of Patent: Oct. 27, 1987

[54] FOUNDRY MOLD FOR CAST-TO-SIZE ZINC-BASE ALLOY

[75] Inventor: Hal H. Rice, Birmingham, Mich.

[73] Assignee: General Motors Corporation, Detroit, Mich.

[21] Appl. No.: 926,157

[22] Filed: Nov. 3, 1986

[51] Int. Cl.[4] ..... B22C 1/08

[52] U.S. Cl. ..... 164/529; 106/38.9

[58] Field of Search ..... 164/529, 519; 106/38.27, 38.9

[56] References Cited

U.S. PATENT DOCUMENTS 4,108,672 8/1978 Klug et al. ..... 164/132 X

FOREIGN PATENT DOCUMENTS 56163 7/1982 European Pat. Off. ..... 164/529

58-205643 11/1983 Japan ..... 164/529

60-166140 8/1985 Japan ..... 164/529

*Primary Examiner*—Kuang Y. Lin

*Attorney, Agent, or Firm*—Douglas D. Fekete

[57] ABSTRACT

A foundry mold for casting to size a material-forming die of a zinc-base alloy is formed by compacting and sintering a particulate mixture composed predominantly of alumina particles and containing raw kyanite particles. During sintering, the raw kyanite particles react to expand the mold by an amount sufficient to compensate for shrinkage of the solidified alloy during cool down.

2 Claims, 2 Drawing Figures

FOUNDRY MOLD FOR CAST-TO-SIZE ZINC-BASE ALLOY

BACKGROUND OF THE INVENTION

This invention relates to a foundry mold for casting a zinc-base alloy, for example, to produce a material-forming die. More particularly, this invention relates to making a mold by sintering a preform of a predominantly alumina particulate mixture that expands during sintering to enlarge a metal-molding cavity to compensate for casting shrinkage during cool down.

In mass production, repetitious forming operations, such as sheet metal stamping or polymer molding, are performed by metal dies. A typical die has a face sized and shaped to fashion a predetermined design in the formed material. Precise die face dimensions are needed to achieve an accurate product design.

Common die-making practice involves precision machining a metal block to sculpture the die face. Such machining is difficult and expensive and substantially prolongs the time required to introduce a product into production. It has been proposed to cast a die so as to substantially form the working face in the casting. A foundry mold is formed from a pattern and defines an open-top casting cavity having a lower surface which bears an impression of the pattern face. Metal is cast into the cavity to produce the die. Finish machining is minimized by a die face that is cast to size, by which is meant that the as-cast face accurately conforms to the desired die face.

A problem in casting to size concerns distortion as a result of shrinkage of the metal during cooling and solidification. This invention is better understood by distinguishing presolidification shrinkage and post-solidification shrinkage. In general, shrinkage that occurs before the metal completely solidifies tends to be nonuniform, i.e., some regions shrink more than others. However, a zinc-base alloy having sufficient durability for die use has been found that is castable with minimal distortion due to presolidification shrinkage. The alloy comprises about 3 to 6 weight percent aluminum, about 5 to 11 weight percent copper and the balance substantially zinc. The alloy is preferably cast in a partially solidified slush form. See U.S. patent application Ser. No. 564,971, filed Oct. 31, 1983, now abandoned.

In contrast, shrinkage of the solidified metal is more uniform. It is a common practice to scale the pattern dimensions greater than the desired die dimensions by a predicted factor to compensate for post-solidification shrinkage. For example, the described zinc-base alloy typically requires a scale-up of about one percent to compensate for post-solidification shrinkage. However, where a model article is available, it is desirable to manufacture the die by constructing a pattern from the article or model without an intermediate scale-up. Similarly, where a model of a die is available, it is desired to use the model as the pattern without resorting to construction of a scaled-up pattern.

It is an object of this invention to provide a method for casting a zinc-base alloy to substantially duplicate a pattern that comprises compacting and sintering a particulate material to form a foundry mold, which material expands during sintering by an amount effective to compensate for post-solidification of the casting. Thus, the product casting accurately conforms to the pattern.

It is a further object of this invention to provide a method for forming a foundry mold for casting to size a die of zinc-base alloy, preferably the described zinc-aluminum-copper alloy, which mold is formed from a pattern that precisely conforms to the desired die working face, but which mold has dimensions larger than the pattern dimensions to compensate for alloy shrinkage. The method comprises compacting a foundry material which is sinterable to produce the mold, but which expands during sintering by an amount corresponding to the post-solidification shrinkage of the alloy. Thus, the cast die after shrinkage accurately replicates the pattern, thereby eliminating the necessity for constructing a scaled-up pattern.

SUMMARY OF THE INVENTION

In accordance with a preferred embodiment of this invention, a foundry mold for casting to size the described zinc-aluminum-copper alloy is produced by sintering a compact formed of a predominantly alumina particulate mixture containing raw kyanite particles in an amount effective to expand the product mold to compensate for post-solidification shrinkage of the cast alloy. The zinc-based alloy exhibits about one percent post-solidification shrinkage. Thus, it is desired that the mold material expand during sintering by about one percent. During casting, the alloy conforms to the mold at the solidus temperature, so that the newly solidified casting is about one percent larger than the desired product and shrinks by that amount during cool down.

Thus, the method of this invention makes possible production of a cast-to-size die from an exact pattern. The particulate mixture that forms the mold compact comprises at least 80 weight percent alumina particles. The mixture also contains between about 3.6 and 6.4 weight percent raw kyanite particles, $3Al_2O_3.3SiO_2$, and may contain up to about 5 weight percent silica particles, $SiO_2$. The balance comprises sintering aids such as titania, fluorspar, magnesium fluoride and cryolite powders. The compact is sintered at a temperature greater than about 1500° C. During sintering, the kyanite, $3Al_2O_3.3SiO_2$, dissociates to form mullite, $3Al_2O_3.2SiO_2$, and silica, $SiO_2$, in accordance with the following reaction:

$$3Al_2O_3.3SiO_2 \rightarrow 3Al_2O_3.2SiO_2 + SiO_2$$

The nascent free silica, together with the silica initially present in the mix, eventually reacts with the excess alumina to form additional mullite as follows:

$$3Al_2O_3 + 2SiO_2 \rightarrow 3Al_2O_3.2SiO_2$$

The product mold is predominantly corundum, derived from the sintered alumina, and comprises mullite, in part derived from the raw kyanite. The dissociation of the kyanite is accompanied by an expansion of the material between about 0.7 and 1.3 percent. This expansion increases the mold dimensions.

To produce a die, the zinc-base alloy is cast into the mold and solidifies. As the metal initially completes solidification, the metal conforms to the mold. Thereafter, as the metal cools to room temperature, the metal contracts by approximately one percent. Because of the expansion of the mold, the product casting has dimensions substantially corresponding to the pattern.

Therefore, the method of this invention permits a die to be cast from an exact pattern of the die, in contrast to a process that would produce a casting from an oversized pattern. Minimal machining is required to true-up die face dimensions.

DESCRIPTION OF THE DRAWINGS

The present invention will be further illustrated with reference to the accompanying drawings wherein.

DETAILED DESCRIPTION OF THE INVENTION

Figure 1:
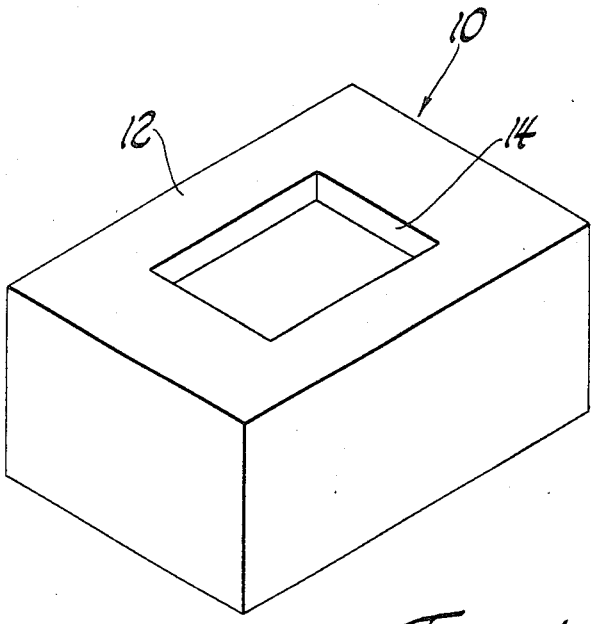
FIG. 1 is a perspective view of a material-forming die cast to size in accordance with the method of this invention.

For illustrative purposes, the method of this invention is described for manufacturing a material-forming die 10 in FIG. 1, although the method is not limited to a particular die shape or size and is suitable for casting a die of more complex design. Die 10 comprises a principal face 12 that includes a recess 14, for example, for defining a cavity for receiving and molding a polymer material. To cast die 10 to size, an accurate pattern of the die is made of a material, such as wood or plaster, that is relatively easy to shape in comparison to the difficulty of metal machining. The pattern is used to form a foundry mold 20 in FIG. 2 defining an open-top cavity 22 having a lower surface 24 bearing an impression of die face 12, which impression is enlarged to compensate for post-solidification alloy shrinkage.

In accordance with this invention, mold 20 is formed from a particulate mixture. Examples of preferred particulate mixture of this invention are presented in Table I. In each example, the mixture is predominantly coarse tabular alumina particles having a commercial grade designation of 28 mesh, by which is meant that the bulk of the particles pass through a 28 mesh screen. The mixture also comprises fine alumina particles to improve packing. Of significance to the present invention, the mixture comprises raw kyanite particles. By raw kyanite, it is meant that the kyanite has not been prematurely calcined to transform the kyanite to mullite. Suitable raw kyanite is commercially available having a grade designation of 35 mesh. The silica powder is predominantly 200 mesh or finer. The titania, calcium fluoride, magnesium fluoride and cryolite were added as fine powders. In addition to the particulate constituents, about 8.56 parts aqueous calcium-based lignosulfonate binder and 1.9 parts water are added to provide green strength in the presintered compact. The binder is destroyed during sintering, and the products thereof, together with the water, are vaporized, leaving no significant residue.

TABLE I

MOLD-FORMING PARTICULATE MIXTURE

| Constituent | Mixture A | Mixture B | Mixture C | Mixture D |
|---|---|---|---|---|
| | (Parts by Weight) | | | |
| Raw kyanite | 4.5 | 7.0 | 7.5 | 8.0 |
| Coarse alumina | 107.5 | 105.0 | 104.5 | 104.0 |
| Fine alumina | 4.0 | 4.0 | 4.0 | 4.0 |
| Silica | 6.0 | 6.0 | 6.0 | 6.0 |
| Titania | 1.6 | 1.6 | 1.6 | 1.6 |
| Calcium fluoride | 0.2 | 0.2 | 0.2 | 0.2 |
| Magnesium fluoride | 0.3 | 0.3 | 0.3 | 0.3 |
| Cryolite | 0.2 | 0.2 | 0.2 | 0.2 |
| Total | 124.3 | 124.3 | 124.3 | 124.3 |
| Sintered growth, % | 0.73 | 1.05 | 1.24 | 1.49 |

The green mixture is rammed about the pattern to produce a compact having approximately the shape of mold 20. After removing the pattern, the compact is sintered by heating at 1,565° C. for about one hour. Sintering bonds the mixture into an integral structure suitable for foundry use. The product is formed mainly of corundum and comprises mullite derived from decomposition of the kyanite and reaction with nascent and original silica with the excess alumina. Also of significance in this invention, sintering causes the material to expand by an amount dependent upon the raw kyanite content. Table I reports the approximate percentage growth of cavity 22 relative to the compact —and thus the pattern—for the described mixtures.

Figure 2:
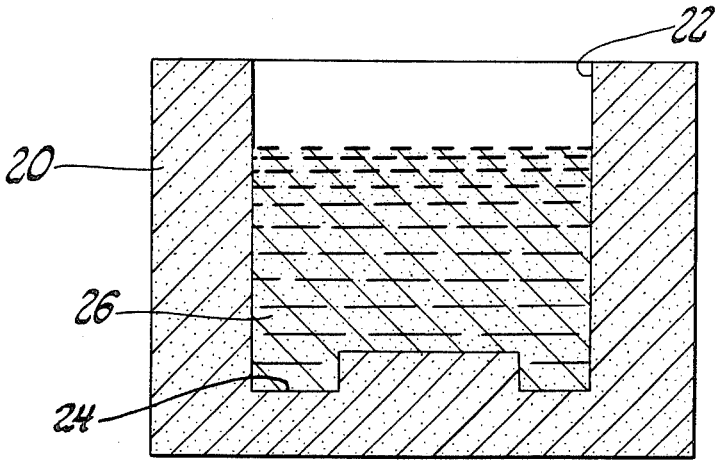
FIG. 2 is a cross-sectional view of a foundry mold for casting the die in FIG. 1.

Into mold 20 is cast a zinc-base alloy. A preferred alloy is composed of, by weight, about 10 percent copper, about 3.6 percent aluminum, about 0.05 percent magnesium and the balance zinc and impurities. Prior to casting, a homogenous melt is prepared in a crucible and cooled to commence solidification, which occurs at a temperature of about 525° C. During cooling, the metal is vigorously stirred to disperse the nascent solids and maintain a more uniform temperature. As a result of stirring and cooling, a slush is formed comprising microparticles distributed within a still-molten phase. This stirring and cooling is continued until the metal temperature approaches approximately 440° C., whereupon about half the metal is solidified. The resulting slush 26 is then cast into mold 20 and shaped against lower surface 24, as depicted in FIG. 2. In comparison to casting a homogenous melt, slush 26 minimizes in-mold presolidification shrinkage. Thus, as the melt completes solidification within mold 20, the casting more accurately conforms to die face impression 24. After complete solidification, the casting may be removed from mold 20. The casting undergoes thermal contraction as the metal cools to ambient temperature. For the preferred alloy, the post-solidification shrinkage is about one percent.

Therefore, the method of this invention produces a casting 10 that accurately conforms to a die pattern. Dimensions of the presintered compact accurately conform to the pattern. Expansion during sintering expands the mold by an amount of about one percent, particularly for Mixture B in Table I. The zinc metal is cast to minimize presolidification shrinkage, but undergoes post-solidification shrinkage of about one percent. As a result, the cast die accurately conforms to the pattern. Minimal machining is required to correct dimensions and finish the die.

Referring to Table I, preferred mold-forming mixtures for use in this invention undergo an expansion during sintering depending upon the raw kyanite content. For comparison, an alumina mixture similar in composition to the mixtures in Table I, but containing no kyanite, contracts during sintering. In general, this invention is intended for casting an alloy comprising at least 80 percent zinc. Preferred alloys contain between 3 and 6 percent aluminum and 5 and 11 percent copper. Such zinc-base alloys exhibit post-solidification shrinkage of about one percent, although the precise shrinkage may depend upon the specific composition. In the practice of this invention, it is desired to select a particular alloy, determine the specific shrinkage for the alloy, and select a raw kyanite content sufficient to produce a corresponding mold expansion. In the examples in Table I, molds having an expansion up to about 1.5 percent were formed by a raw kyanite content in the mixture up to about 6.4 weight percent. Preferably, a mold having an expansion between about 0.7 and 1.3 percent is formed using a raw kyanite addition between about 3.6 and 6.1 weight percent. As used herein, weight percent is determined with reference to the weight of the sintered product, and does not include fugitive additives, such as binder and water, which are added to the particulate mixture to produce a self-sustaining compact of suitable strength.

The particulate material for forming a mold in accordance with this invention is formed predominantly of alumina, preferably at least 80 percent. This provides an excess of alumina to react with nascent silica formed upon kyanite decomposition. Also, the particulate mixture may contain silica particles, which also react with the excess alumina to form an additional mullite phase in the product sintered mold. The mixture may also contain sintering aids, such as titania, fluorspar, magnesium fluoride and cryolite, useful in the sintering of alumina.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for making a foundry mold for casting a zinc-base alloy to substantially duplicate a pattern, the method comprising compacting a particulate mixture about the pattern, removing the pattern to produce a self-sustaining compact defining a cavity sized and shaped corresponding to the pattern and sintering the compact to produce a mold, said mixture being composed predominantly of alumina particles and containing raw kyanite particles in an amount between about 3.6 and 6.4 weight percent and effective to react with the alumina during sintering to expand the mold cavity by an amount within a range between about 0.7 and 1.5 percent and sufficient to compensate for post-solidification shrinkage of the alloy.

2. A method for making a foundry mold for casting to size a material-forming die from a pattern of said die, said pattern having a face sized and shaped substantially corresponding to a desired die working face, said mold being adapted for casting a zinc-base alloy metal and defining a metal molding cavity having an open top and a lower surface bearing an impression corresponding to said die face but expanded to compensate for alloy shrinkage, said method comprising compacting a particulate mixture about said pattern to produce a self-sustaining compact and sintering said compact to produce said mold, said particulate mixture being predominantly composed of alumina particles and containing raw kyanite in an amount between 3.6 and 6.1 weight percent and effective to react during sintering to uniformly expand said cavity by an amount within a range between 0.7 and 1.3 percent to compensate for post-solidification shrinkage of said alloy.

* * * * *